US006653999B2

(12) United States Patent
Motegi et al.

(10) Patent No.: US 6,653,999 B2
(45) **Date of Patent: *Nov. 25, 2003**

(54) INTEGRATED CIRCUIT FOR DRIVING LIQUID CRYSTAL

(75) Inventors: Shuji Motegi, Ashikaga (JP); Hiroyuki Arai, Gunma (JP); Tetsuya Tokunaga, Gunma (JP)

(73) Assignee: Sanyo Electric Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/460,171

(22) Filed: Dec. 10, 1999

(65) Prior Publication Data

US 2003/0011558 A1 Jan. 16, 2003

(30) Foreign Application Priority Data

Dec. 15, 1998 (JP) ..... 10-356446

(51) Int. Cl.[7] ..... G09G 3/36

(52) U.S. Cl. ..... 345/100; 345/84; 345/85; 345/87; 345/89; 345/90; 345/95; 345/98; 345/99; 345/211; 345/212; 345/204; 327/540; 315/169.1; 315/169.2; 315/169.3; 315/169.4

(58) Field of Search ..... 345/100, 211, 345/212, 89, 90, 87, 85, 84, 95, 98, 99, 204; 315/169.1, 169.2, 169.3, 169.4; 327/540

(56) References Cited

U.S. PATENT DOCUMENTS

| | | | | | |
|---|---|---|---|---|---|
| 4,403,777 | A | * | 9/1983 | Del Principe et al. | 273/313 |
| 5,159,326 | A | | 10/1992 | Yamazaki et al. | 340/784 |
| 5,250,937 | A | | 10/1993 | Kikuo et al. | 345/89 |
| 5,467,009 | A | * | 11/1995 | McGlinchey | 323/269 |
| 5,498,932 | A | | 3/1996 | Shin et al. | 315/169.3 |
| 5,517,212 | A | | 5/1996 | Inoue | 345/211 |
| 5,532,718 | A | | 7/1996 | Ishimaru | 345/211 |
| 5,574,475 | A | | 11/1996 | Callahan, Jr. et al. | 345/100 |
| 5,627,457 | A | * | 5/1997 | Ishiyama et al. | 323/318 |
| 5,646,643 | A | | 7/1997 | Hirai et al. | 345/100 |
| 5,745,092 | A | | 4/1998 | Ito | 345/95 |
| 5,793,606 | A | * | 8/1998 | Cubbage et al. | 361/681 |
| 5,795,069 | A | * | 8/1998 | Mattes et al. | 374/183 |
| 5,932,990 | A | * | 8/1999 | Kaneko | 320/116 |
| 5,995,072 | A | | 11/1999 | Nakajima | 345/87 |
| 6,181,313 | B1 | | 1/2001 | Yokota et al. | 345/100 |
| 6,225,992 | B1 | * | 5/2001 | Hsu et al. | 345/211 |
| 6,229,510 | B1 | * | 5/2001 | Kim et al. | 345/87 |
| 6,275,209 | B1 | | 8/2001 | Yamamoto | 345/95 |

FOREIGN PATENT DOCUMENTS

| | | |
|---|---|---|
| EP | 0 642 112 | 3/1995 |
| WO | 98/28731 | 7/1998 |

* cited by examiner

*Primary Examiner*—Richard Hjerpe
*Assistant Examiner*—Abbas Abdulselam
(74) *Attorney, Agent, or Firm*—Hogan & Hartson, LLP

(57) ABSTRACT

A liquid crystal driving integrated circuit capable of adjusting display contrast and requiring no externally attached components. A resistor formed by four serially connected resistor elements R1 has one end connected to a reference voltage VLCD0 applied from an operational amplifier 8, and the other end connected to an external variable resistor 25 through a terminal 24. Consequently, liquid crystal driving voltages VLCD0, VLCD1, VLCD2, VLCD3, and VLCD4 can be finely adjusted not only by eleven versions of reference voltage VLCD0 in accordance with voltages at respective connection points of twelve serially connected resistor elements, but by changing the resistance of the external variable resistor 25, to thereby provide a liquid crystal driving integrated circuit 1 that can be used for a variety of general purposes. Since only one external variable resistor 25 is required and this resistor is inherently variable, there is no need to consider variation in characteristics.

3 Claims, 6 Drawing Sheets

| CONTROL DATA | | | | CONTROL SIGNALS | | | | | | | | | | | REFERENCE VOLTAGE |
|---|---|---|---|---|---|---|---|---|---|---|---|---|---|---|---|
| D0 | D1 | D2 | D3 | CA0 | CA1 | CA2 | CA3 | CA4 | CA5 | CA6 | CA7 | CA8 | CA9 | CA10 | VLCD0 |
| 0 | 0 | 0 | 0 | H | L | L | L | L | L | L | L | L | L | L | V0 |
| 1 | 0 | 0 | 0 | L | H | L | L | L | L | L | L | L | L | L | V1 |
| 0 | 1 | 0 | 0 | L | L | H | L | L | L | L | L | L | L | L | V2 |
| 1 | 1 | 0 | 0 | L | L | L | H | L | L | L | L | L | L | L | V3 |
| 0 | 0 | 1 | 0 | L | L | L | L | H | L | L | L | L | L | L | V4 |
| 1 | 0 | 1 | 0 | L | L | L | L | L | H | L | L | L | L | L | V5 |
| 0 | 1 | 1 | 0 | L | L | L | L | L | L | H | L | L | L | L | V6 |
| 1 | 1 | 1 | 0 | L | L | L | L | L | L | L | H | L | L | L | V7 |
| 0 | 0 | 0 | 1 | L | L | L | L | L | L | L | L | H | L | L | V8 |
| 1 | 0 | 0 | 1 | L | L | L | L | L | L | L | L | L | H | L | V9 |
| 0 | 1 | 0 | 1 | L | L | L | L | L | L | L | L | L | L | H | V10 |

Fig. 6

INTEGRATED CIRCUIT FOR DRIVING LIQUID CRYSTAL

BACKGROUND OF THE INVENTION

1. Field of the Invention

The present invention relates to an integrated circuit for driving liquid crystal capable of adjusting display contrast.

2. Description of the Related Arts

FIG. 1 is a circuit block diagram illustrating a method of adjusting display contrast using a conventional integrated circuit for driving liquid crystal.

Referring to FIG. 1, a liquid crystal panel 101 includes a plurality of segment electrodes and a plurality of common electrodes arranged in a matrix. A segment driving signal and a common driving signal are applied to the plurality of segment electrodes and the plurality of common electrodes of the liquid crystal panel 101, respectively, and light is turned on only at the intersections of the matrix for which the potential difference between the segment driving signal and the common driving signal exceeds a prescribed value.

A liquid crystal driving integrated circuit 102 drives the liquid crystal panel 101 to present a display. In the liquid crystal driving integrated circuit 102, respective connection points of four serially connected resistor elements R1 forming a resistor are connected to terminals 103–107. The terminal 103 receives a reference voltage VLCD0 setting peak values of the segment and common driving signals, and the terminal 107 connects all components of the circuit 102 in common to ground. The potential difference between the reference voltage VLCD0 and a ground voltage Vss is quartered by the four resistor elements R1. The voltages at the terminals 103–107 will be hereinafter denoted as VLCD0, VLCD1, VLCD2, VLCD3, and Vss, respectively. The common driving circuit 108 receives the voltages VLCD0, VLCD1, VLCD3, and Vss to generate the common driving signal. The common driving signal changes between the reference voltage VLCD0 and the ground voltage Vss to turn on light at the liquid crystal panel 101, and changes between the voltages VLCD1 and VLCD3 to turn off light at the panel 101. Therefore, in this case, the common driving signal assumes a ¼ bias driving waveform. On the other hand, a segment driving circuit 109 receives the voltages VLCD0, VLCD2, and Vss to generate the segment driving signal. When a light is to be turned on at the liquid crystal panel 101, the segment driving signal changes between the reference voltage VLCD0 and the ground voltage Vss in a phase opposite to that of the common driving signal for turning on light. On the other hand, the segment driving signal remains unchanged at the voltage VLCD2 when light is to be turned off at the panel 101. The reference voltage VLCD0 determines display contrast (difference in display between when light is on and off) of the liquid crystal panel 101. Therefore, the display contrast of the liquid crystal panel 101 can be optimized by having a variable reference voltage VLCD0 and changing the amplitudes of the common and segment driving signals.

A reference voltage generation circuit 110 applies the reference voltage VLCD0 to the terminal 103. In the circuit 110, a resistor 111 and a variable resistor 112 are connected in series between a power supply voltage Vdd and a ground voltage Vss. An operational amplifier 113 outputs a voltage equal to that present at the connection point between the resistor 111 and the variable resistor 112 as the reference voltage VLCD0. When the impedance of the resistor formed by the four serially connected resistor elements R1 exceeds the load impedance of the liquid crystal panel 101 and the like, the voltages VLCD1-3 are likely to be unsettled. Therefore, the operational amplifier 113 having a small output impedance is used. A resistor may be externally connected between the terminals 103–107 to form a resistor member connected in parallel to the four serially connected resistor elements R1, to thereby reduce the impedance on the side of the serially connected resistor elements R1. The reference voltage generation circuit 110 receives a control signal for changing the value of the variable resistor 112 from an external controller. Thus, the reference voltage VLCD0 is changed under the control of the external controller, to thereby adjust the display contrast of the liquid crystal panel 101.

However, in the circuit arrangement of FIG. 1, the reference voltage generation circuit 110 must be externally connected to the liquid crystal driving integrated circuit 102. Thus, as the circuit 110 includes a great number of elements, it would impede reduction of cost of electronic devices. In addition, ports of the external controller for specific use are dedicated for output of control signals, which would hinder the electronic devices from assuming higher functions.

FIG. 2 is another circuit block diagram illustrating a method of adjusting display contrast using a conventional liquid crystal driving integrated circuit, which attempts to solve the problems of the circuit in FIG. 1. In FIG. 2, the liquid crystal panel 101, the common driving circuit 108, and the segment driving circuit 109 of FIG. 1 are not shown.

In the integrated circuit 201 for driving liquid crystal, the respective connection points of the four serially connected resistor elements R1 are connected to terminals 202–206 for a similar purpose to that described in connection with FIG. 1. The terminal 202 is a power supply terminal receiving the power supply voltage Vdd. A regulator 207 outputs a constant voltage VRF based on the power supply voltage Vdd. An operational amplifier 208 has a positive terminal connected to the constant voltage VRF, a negative terminal connected to a terminal 209, and an output terminal connected to the terminal 206. The value of current IR flowing across the negative terminal of the operational amplifier 208 can be adjusted under the control of an internal controller.

Three serially connected external resistor elements R2, R3, and R4 forming another resistor are connected between the terminals 202 and 206, and an intermediate terminal of the external resistor element R3 is connected to the terminal 209. The serially connected resistor elements R2, R3, and R4 are divided into two parts by the intermediate terminal of the resistor element R3. The resistance of the part consisting of the resistor element R2 and a portion of the resistor element R3 will be denoted as Ra, and that of the part consisting of the remaining portion of the resistor element R3 and the resistor element R4 as Rb.

A voltage VLCD4 can be given by $((Ra+Rb)/Ra)VRF+IR \cdot Rb$. Thus, the value of current IR is controlled by the internal controller to change the voltage VLCD4, thereby adjusting the display contrast of the liquid crystal panel 101.

However, while the liquid crystal driving integrated circuit 201 of FIG. 2 requires only the resistor elements R2, R3, and R4 as external elements, a ratio of the voltages Ra and Rb would deviate from the expected value because of variation in resistance of the resistor elements R2, R3, and R4, making it impossible to achieve appropriate display contrast. Consequently, the variation in resistance of the resistor elements R2–R4 must be corrected under the control of the external controller, resulting in similar problems to those discussed in connection with FIG. 1.

SUMMARY OF THE INVENTION

An object of the present invention is to provide an integrated circuit for driving liquid crystal that requires no external elements and allows adjustment of display contrast.

The present invention has been conceived to solve the above problems. The present invention provides a liquid crystal driving integrated circuit for generating liquid crystal driving voltages that drive a liquid crystal panel to present a display from respective connection points of a plurality of serially connected resistor elements forming a first resistor. In the liquid crystal driving integrated circuit, a reference voltage applied to one end of the first resistor is variable so as to adjust the display contrast of the liquid crystal panel. The above integrated circuit includes a second resistor formed by a plurality of serially connected resistor elements and connected to a power supply, a reference voltage generation circuit having a selection circuit for deriving one of the voltages at respective connection points of the plurality of serially connected resistor elements forming the second resistor, and generating the reference voltage based on an output of the selection circuit, and a plurality of terminals for deriving the voltages at respective connection points of the plurality of serially connected resistor elements forming the first resistor, and capable of connecting an external resistor with the connection points of the resistor elements forming the first resistor, from which points the liquid crystal driving voltages excluding the reference voltage are derived. The display contrast of the liquid crystal panel is adjusted by changing the voltages at both ends of the first resistor formed by the serially connected resistor elements.

BRIEF DESCRIPTION OF THE DRAWINGS

FIG. 6 shows a relationship among control data, control signals, and reference voltages.

DESCRIPTION OF THE PREFERRED EMBODIMENTS

The present invention will be described in detail with reference to the drawings.

Figure 3:
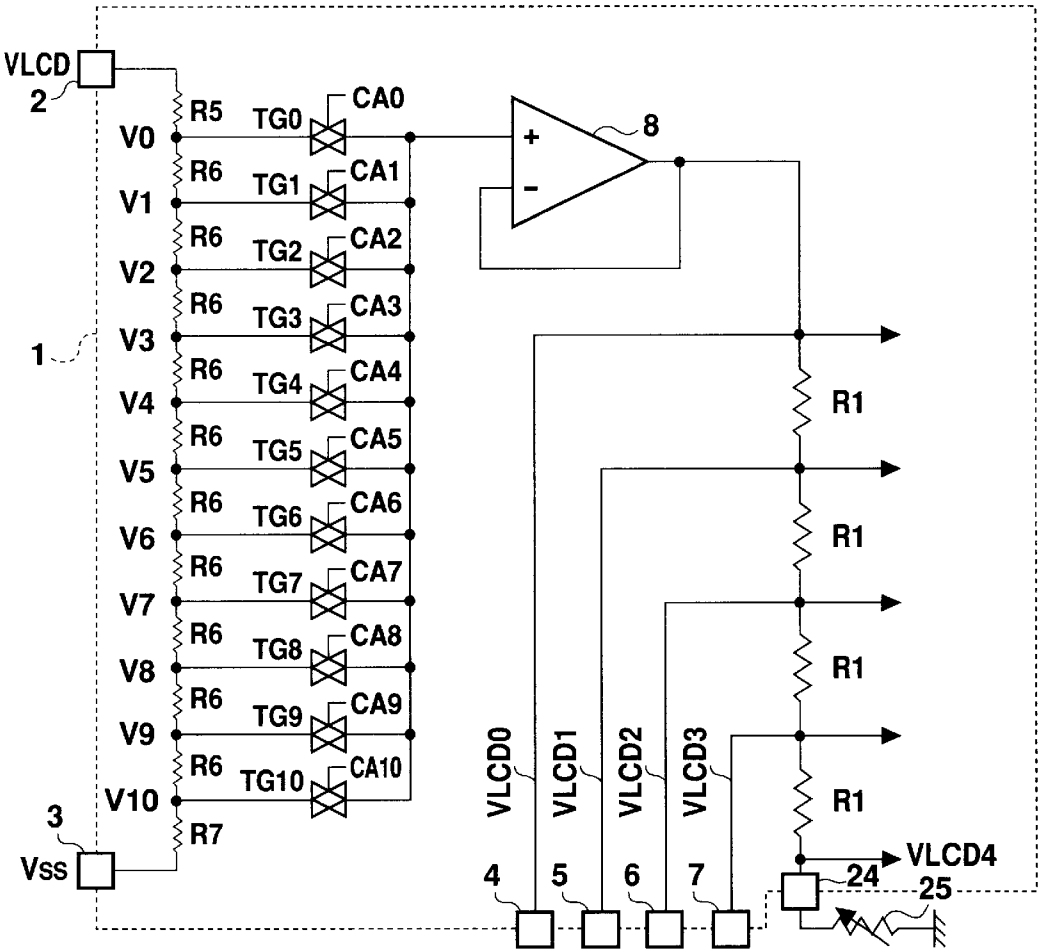
FIG. 3 is a circuit diagram illustrating a main part of a liquid crystal driving integrated circuit according to a first embodiment of the present invention.

FIG. 3 is a circuit diagram showing a main part of a liquid crystal driving integrated circuit according to an embodiment of the present invention.

Referring to FIG. 3, a liquid crystal driving integrated circuit 1 shown in the broken lines includes a terminal 2 for receiving a power supply voltage VLCD for driving liquid crystal, a terminal 3 for receiving a ground voltage Vss, and terminals 4, 5, 6, 7, and 24 for providing voltages VLCD0, VLCD1, VLCD2, VLCD3, and VLCD4 at respective connection points of four serially connected resistor elements R1 forming a resistor. The terminal 24 is connected to the ground voltage Vss or an external variable resistor 25. More specifically, when the terminal 24 is connected to the ground voltage Vss, the voltages VLCD0, VLCD1, VLCD2, VLCD3, and VLCD4 are determined only by an output of an operational amplifier described hereinafter. On the other hand, when the terminal 24 is connected to the external variable resistor 25, the voltages VLCD0, VLCD1, VLCD2, VLCD3, and VLCD4 are determined by the resistance of the external variable resistor 25 and the output of the operational amplifier. Thus, the voltages VLCD0, VLCD1, VLCD2, VLCD3, and VLCD4 can be adjusted more flexibly depending on whether the terminal 24 is connected to ground or to the external variable resistor, to thereby obtain a liquid crystal driving integrated circuit that can be used for more generic purposes. Since only one external variable resistor 25 is required, there is no need to consider variation in characteristics of a plurality of resistor elements as compared to the conventional devices.

In the integrated circuit 1 for driving liquid crystal, twelve resistor elements, including a resistor element R5, ten resistor elements R6, and a resistor element R7, are connected in series between the power supply terminal 2 and the ground terminal 3. At the connection points of these twelve resistor elements connected in series, eleven voltages V0–V10 are generated divided by respective resistance values. As the twelve resistor elements connected in series are integrated on a single semiconductor substrate, variation in resistance due to manufacturing of the twelve resistor elements will be the same. Thus, the voltages V0–V10 determined by the ratio of resistance values will not be affected by the variation generated during manufacturing, so that a stable reference voltage VLCD0 can be obtained. Each of eleven transmission gates TG0–TG10 has one end connected to a connection point of the twelve serially connected resistor elements, and derives one of the eleven voltages V0–V10 in accordance with control signals CA0–CA10. The control signals CA0–CA10 are binary signals attaining either high level (logic "1") or low level (logic "0"), with only one of the control signals CA0–CA10 attaining a high level.

An operational amplifier 8 has a positive (non-inverting input) terminal connected in common to respective other ends of the transmission gates TG0–TG10, providing as an output the reference voltage VLCD0 for liquid crystal display based on the voltage output from one of the transmission gates TG0–TG10. It should be noted that when the impedance of the resistor formed by the four serially connected resistor elements R1 exceeds the load impedance of the succeeding liquid crystal driving circuit, liquid crystal panel, and the like, the voltages VLCD1, VLCD2, VLCD3, and VLCD4 are likely to be unsettled due to decrease in current flowing across the serially connected resistor elements R1. Therefore, taking the magnitude of the load impedance into consideration, an operational amplifier 8 with a low output impedance is used. It is also effective to connect an external resistor between any combination of the terminals 3–7 to be in parallel to the four serially connected resistor elements R1, to thereby reduce the impedance on the side of the resistor elements R1.

Figure 1:
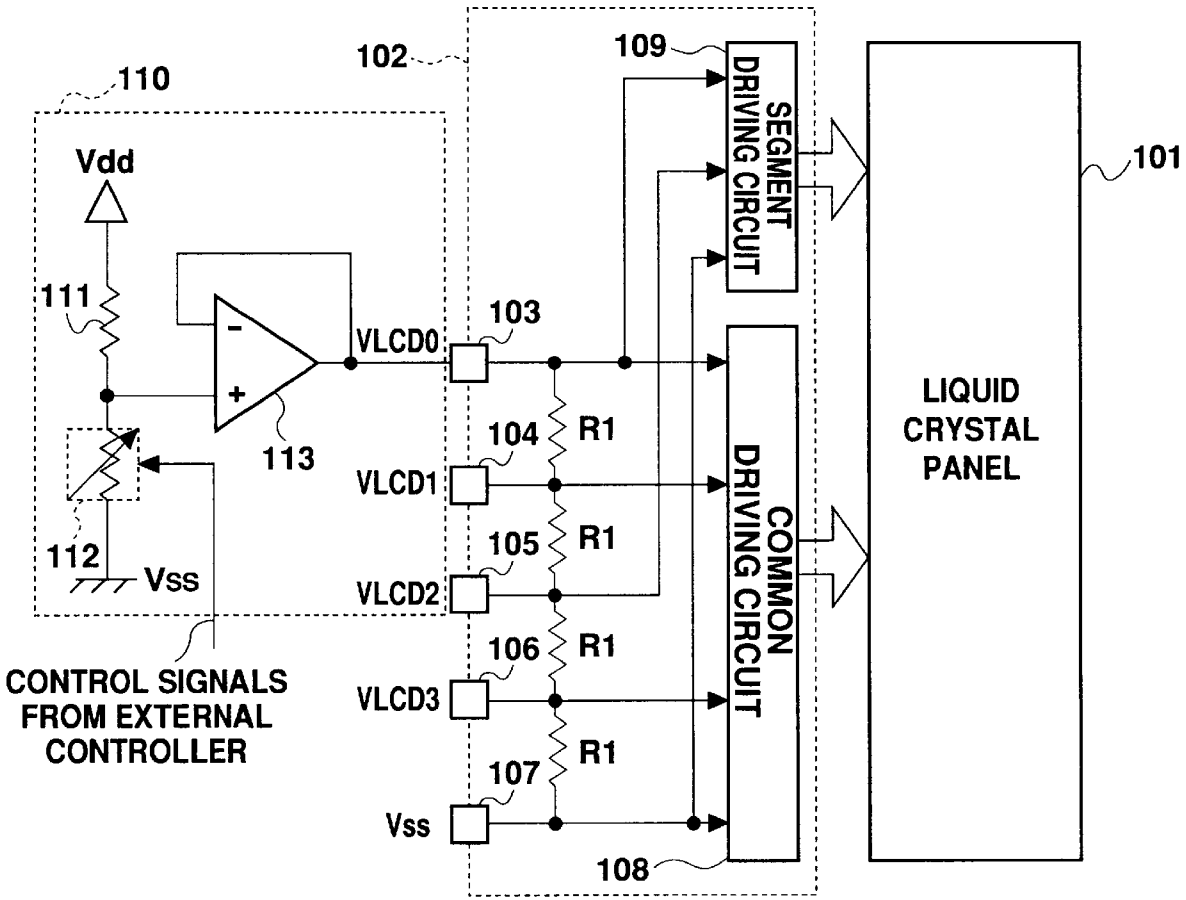
Fig. 1 PRIOR ART
FIG. 1 is a circuit block diagram illustrating a conventional integrated circuit for driving liquid crystal.
Figure 2:
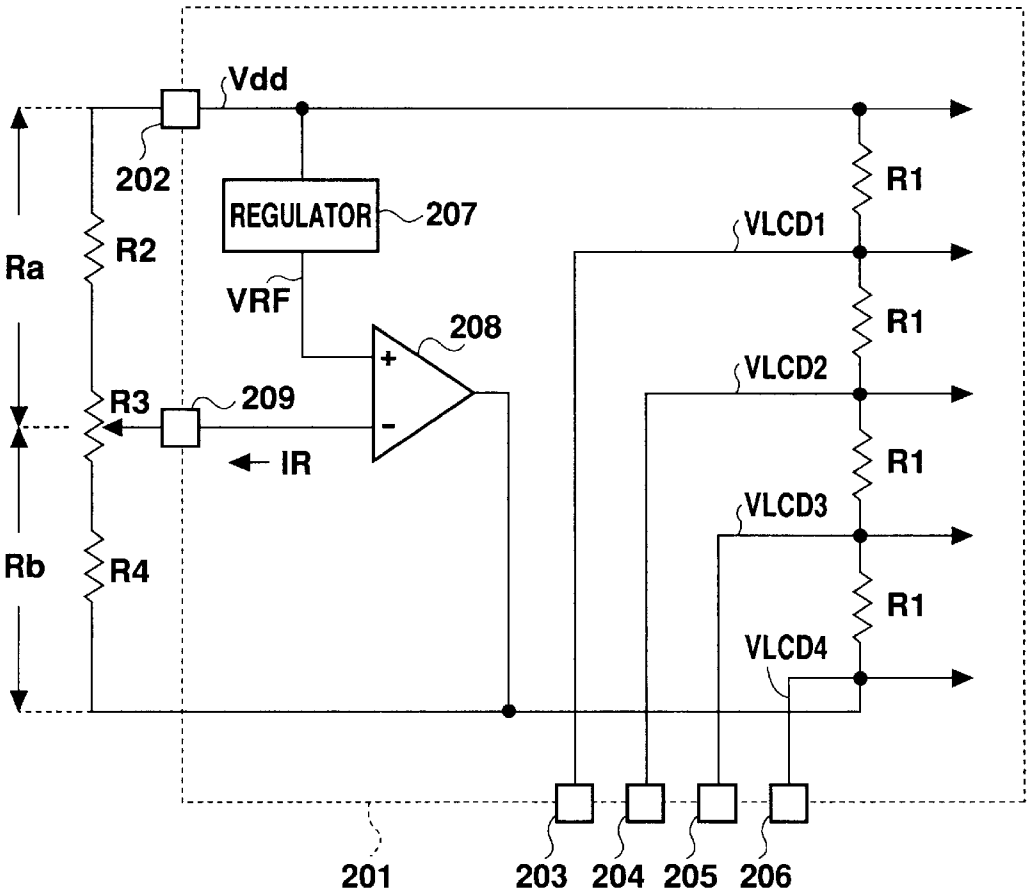
Fig. 2 PRIOR ART
FIG. 2 is another circuit block diagram illustrating a conventional integrated circuit for driving liquid crystal.

The five voltages VLCD0, VLCD1, VLCD2, VLCD3, and VLCD4 obtained at respective connection points of the four serially connected resistor elements R1 are applied to a common driving circuit and a segment driving circuit, as in the circuit of FIG. 1. The liquid crystal panel receives common and segment driving signals to display a character and the like. As the stage succeeding the four serially connected resistor elements R1 is the same as that of the circuit shown in FIG. 1, description thereof with reference to FIG. 3 will not be repeated.

Figure 4:
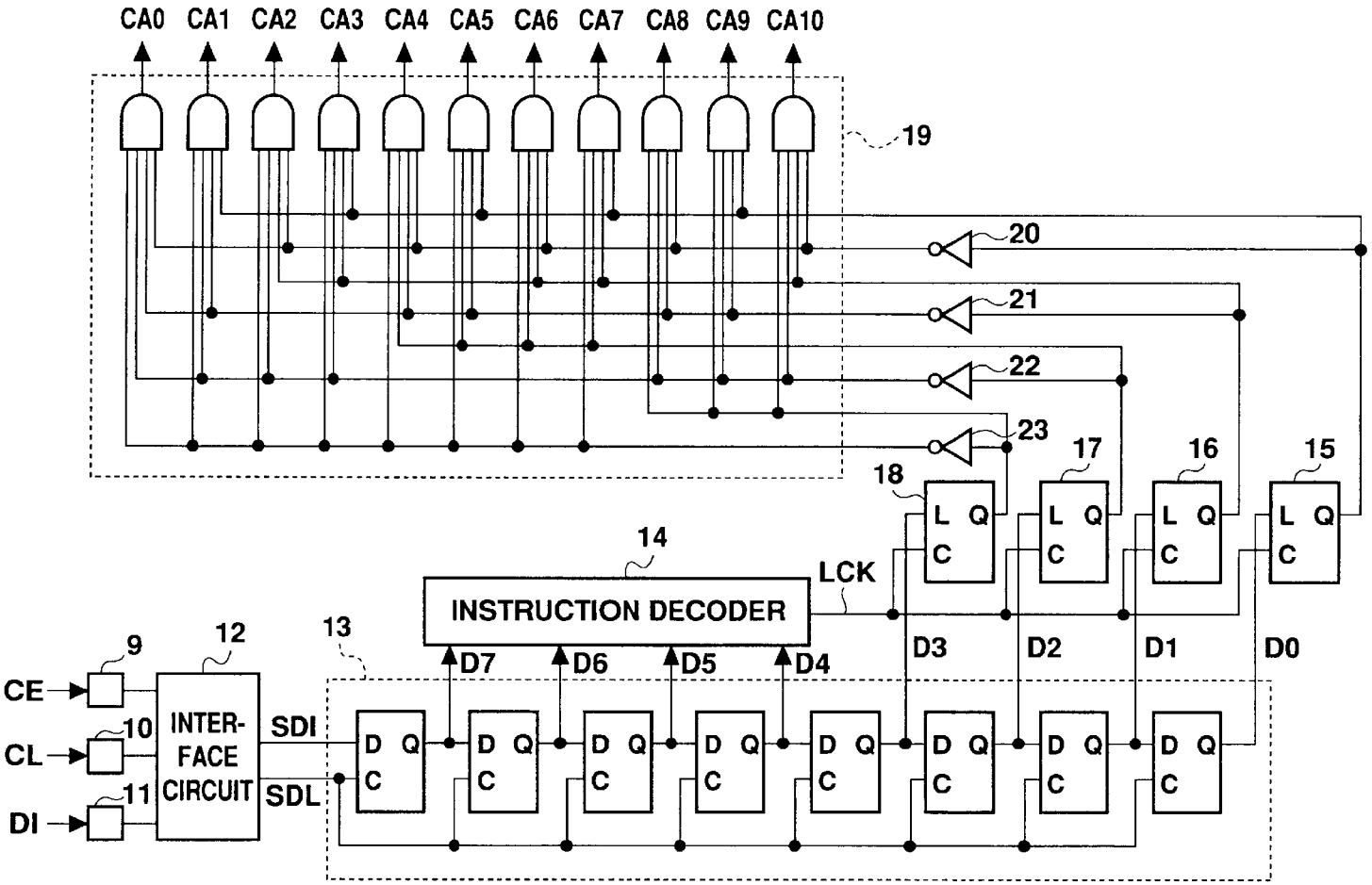
FIG. 4 is a circuit diagram illustrating a portion for outputting control signals in the liquid crystal driving integrated circuit according to the first embodiment of the present invention.

FIG. 4 is a circuit block diagram illustrating part of the liquid crystal driving integrated circuit that generates control signals CA0–CA10. According to the present embodiment, the liquid crystal driving integrated circuit 1 serves as an interface between integrated circuits allowing only particular input data.

Terminals 9, 10, and 11 are external input terminals for setting control signals CA0–CA10, receiving an operation enable signal CE, a clock signal CL, and serial data DI from other integrated circuits such as a microcomputer. More specifically, the serial data DI contains, in a serial manner, unique address data for identifying the liquid crystal driving integrated circuit 1, and control data for setting control signals CA0–CA10. The serial data DI can be output from a serial output port of an external controller such as a microcomputer. An interface circuit 12 detects the status of the operation enable signal CE, the clock signal CL, and the serial data DI, and outputs control data SDI and a clock signal SCL. More specifically, the interface circuit 12 detects a match of the address data when the operation enable signal CE is at the low level, and outputs the control data when the operation enable signal CE changes to the high level.

Figure 5:
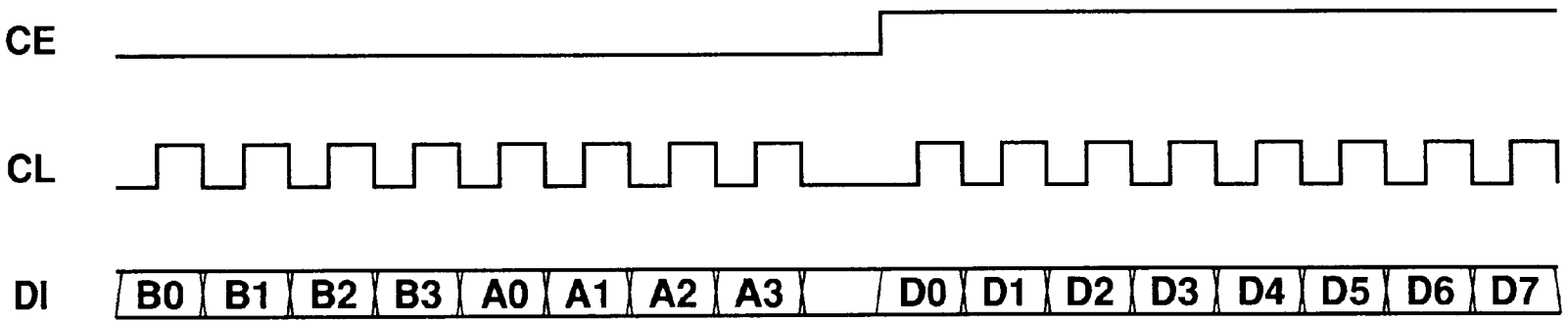
FIG. 5 is a timing chart of externally input signals.

Operation of the interface circuit 12 will be described with reference to the timing chart shown in FIG. 5. When the operation enable signal CE is at the low level, the interface circuit 12 determines whether or not the address data B0–B3 and A0–A3 supplied in synchronization with the clock signal CL are the unique values predetermined for the liquid crystal driving integrated circuit 1. When the address data B0–B3 and A0–A3 match with the values unique to the circuit 1 and the operation enable signal CE changes to the high level, the interface circuit 12 provides the clock signal CL and the control data D0–D7 as the clock signal SCL and the control data SDI, respectively.

A shift register 13 is formed by cascading eight D flip flops, successively right shifting 8-bit control data D0–D7 in synchronization with the clock signal SCL.

An instruction decoder 14 outputs a latch clock signal LCK when 4 bits D4–D7 of the control data corresponding to an instruction code is detected as the predetermined values unique to the liquid crystal driving integrated circuit 1.

Latch circuits 15, 16, 17, and 18 latch the remaining 4 bits D0–D3 of the 8-bit control data for setting control signals CA0–CA10 in synchronization with the latch clock signal LCK.

A decoder 19 outputs control signals CA0–CA10, only one of which attains a high level, based on eight signals consisting of output signals from respective Q terminals of the latch circuits 15–18 and the inverted versions of these output signals supplied by inverters 20, 21, 22, and 23. More specifically, the decoder 19 includes eleven AND gates, and the above eight signals are wired in a matrix to these eleven AND gates in the decoder 19 so that only one of the control signals CA0–CA10 output from the AND gates attains a high level. FIG. 6 shows a relationship among the control data D0–D3, control signals CA0–CA10, and the reference voltage VLCD0. When the set of control data D0–D3 is one of those shown in FIG. 6, a corresponding one of the control signals CA0–CA10 attains a high level and the reference voltage VLCD0 is correspondingly set as one of the voltages V0–V10.

As described above, the liquid crystal driving integrated circuit 1 of the present embodiment provides the following advantages.

First, the reference voltage VLCD0 for liquid crystal display can be set in eleven stages (voltages V0–V10) simply by changing the control data D0–D3 to a user specified value. Therefore, the display contrast can be adjusted without attaching external components to the liquid crystal driving integrated circuit 1, allowing cost reduction of electronic devices using the circuit Secondly, as serial output ports of the external controller is used, there is no need to use specific ports. Accordingly, the specific ports of the external controller can be used for other purposes, so that the electronic devices using the liquid crystal driving integrated circuit 1 can be provided with higher functions.

Thirdly, the option for the liquid crystal driving voltages VLCD0, VLCD1, VLCD2, VLCD3, and VLCD4 is increased by selectively connecting the terminal 24 to the ground voltage Vss or the external variable resistor, to thereby provide a liquid crystal driving integrated circuit that can be used for more generic purposes.

While the circuit is described as including a first resistor formed by four resistor elements R1 and a second resistor formed by twelve resistor elements, i.e. resistor elements R5, R6, and R7, in this embodiment, respective resistors can include other numbers of serially connected resistor elements.

According to the present invention, the reference voltage for liquid crystal display can be set in a plurality of stages simply by changing the control data to a user specified value. Therefore, the display contrast can be adjusted without attaching external devices to the liquid crystal driving integrated circuit, to thereby achieve cost reduction of electronic devices using the liquid crystal driving integrated circuit. In addition, as serial output ports of the external controller are used, the specific ports will not be occupied, so that the specific ports of the external controller can be used for other purposes and the electronic devices using the liquid crystal driving integrated circuit can be provided with higher functions. Further, the option for the liquid crystal driving voltages VLCD0, VLCD1, VLCD2, VLCD3, and VLCD4 can be widened by connecting one of the terminals for deriving liquid crystal driving voltages to the external resistor, advantageously providing a liquid crystal driving integrated circuit that can be utilized for more generic purposes.

What is claimed is:

1. A liquid crystal driving integrated circuit (1) for generating a liquid crystal driving voltage that drives a liquid crystal panel to present a display from respective connection points of a plurality of serially connected resistor elements forming a first resistor, wherein a reference voltage applied to one end of said first resistor is variable so as to adjust display contrast of said liquid crystal panel, said circuit comprising:

a second resistor formed by a plurality of serially connected resistor elements and connected to a power supply;

a reference voltage generation circuit having a selection circuit for deriving one of voltages at respective connection points of said plurality of resistor elements forming said second resistor, and generating said reference voltage based on an output from said selection circuit;

a plurality of terminals (4–7, 24) for deriving voltages from said connection points of said plurality of serially connected resistor elements forming said first resistor, and capable of connecting an external resistor (25) with said connection points of said resistor elements forming said first resistor, said liquid crystal driving voltage excluding said reference voltage being derived from said connection points;

a holding circuit for holding control data provided from an external source to control said selection circuit;

a decoding circuit (19) for decoding the control data held in said holding circuit and generating a control signal for operating said selection circuit; wherein said holding circuit includes a shift register (13) for holding control data formed by serially connecting first and second bit strings, a clock generation circuit (14) for generating a clock signal based on said first bit string, and a latch circuit (15–18) for latching said second bit string in accordance with said clock signal and supplying said bit string to said decoding circuit; and the display contrast of said liquid crystal panel is adjusted by changing voltage at both ends of said first resistor.

2. A liquid crystal driving integrated circuit including a first resistor formed by a plurality of serially connected resistor elements for generating a liquid crystal driving voltage that drives a liquid crystal panel from at least one of connection points of said plurality of serially connected resistor elements forming said first resistor, wherein a reference voltage applied to one end of said first resistor is changed to adjust display contrast of said liquid crystal panel, said circuit comprising:

a second resistor formed by a plurality of serially connected resistor elements and having one end connected to a power supply;

a reference voltage generation circuit for selecting a voltage at one of end of the plurality of serially connected resistor elements forming said second resistor, and generating said reference voltage based on the selected voltage, at least one connection terminal for connecting an externally attached resistor with one of end of the plurality of resistor elements forming said first resistor;

said liquid crystal driving voltage generated by said integrated circuit can also be changed by said externally attached resistor;

a holding circuit for holding control data provided from an external source; and a decoding circuit for decoding the control data held in said holding circuit and generating a control signal for said reference voltage generation circuit; wherein said holding circuit includes a shift register (13) for holding control data formed by serially connecting first and second bit strings, a clock generation circuit (14) for generating a clock signal based on said first bit string, and a latch circuit (15–18) for latching said second bit string in accordance with said clock signal and supplying said bit string to said decoding circuit.

3. The liquid crystal driving integrated circuit according to claim 2, wherein said connection terminal is connected to the other end opposite to said one end of said first resistor receiving the reference voltage, and said externally attached resistor can be connected in series to said first resistor.

* * * * *